US005538186A

United States Patent [19]

Konieczynski

[11] Patent Number: 5,538,186

[45] **Date of Patent: * Jul. 23, 1996**

[54] APPARATUS AND METHOD FOR DISPENSING ELECTRICALLY CONDUCTIVE COATING MATERIAL INCLUDING A PNEUMATIC/MECHANICAL CONTROL

[75] Inventor: Ronald D. Konieczynski, North Royalton, Ohio

[73] Assignee: Nordson Corporation, Westlake, Ohio

[ * ] Notice: The portion of the term of this patent subsequent to Aug. 30, 2011, has been disclaimed.

[21] Appl. No.: 254,843

[22] Filed: Jun. 6, 1994

Related U.S. Application Data

[63] Continuation of Ser. No. 76,302, Jun. 11, 1993, Pat. No. 5,341,990.

[51] Int. Cl.[6] ..... B05B 5/16

[52] U.S. Cl. ..... 239/3; 239/69; 239/690; 239/691; 239/708

[58] Field of Search ..... 239/3, 690, 691, 239/704, 705, 708, 61, 69; 118/621, 627, 629

[56] References Cited

U.S. PATENT DOCUMENTS

| | | | |
|---|---|---|---|
| 3,240,225 | 3/1966 | Barrows . | |
| 3,315,899 | 4/1967 | Quarve . | |
| 3,747,850 | 7/1973 | Hastings et al. . | |
| 3,864,603 | 2/1975 | Kozinski et al. | 239/691 X |
| 3,895,748 | 7/1975 | Klingenberg . | |
| 3,906,122 | 9/1975 | Krause et al. . | |
| 3,929,286 | 12/1975 | Hastings et al. . | |
| 3,937,400 | 2/1976 | Krause . | |
| 3,971,337 | 7/1976 | Hastings . | |
| 3,999,691 | 12/1976 | Doom . | |
| 4,004,717 | 1/1977 | Wanke . | |
| 4,017,029 | 4/1977 | Walberg . | |
| 4,020,866 | 5/1977 | Wiggins . | |
| 4,053,012 | 10/1977 | Farmer . | |
| 4,085,892 | 4/1978 | Dalton . | |
| 4,124,163 | 11/1978 | Siegmann . | |
| 4,142,707 | 3/1979 | Bjorklund . | |
| 4,232,055 | 11/1980 | Shaffer | 239/3 X |
| 4,275,834 | 6/1981 | Spanjersberg et al. . | |
| 4,313,475 | 2/1982 | Wiggins . | |
| 4,489,893 | 12/1984 | Smead . | |
| 4,544,570 | 10/1985 | Plunkett et al. . | |
| 4,629,119 | 12/1986 | Plunkett et al. . | |
| 4,657,047 | 4/1987 | Kolibas . | |
| 4,660,598 | 4/1987 | Butterfield et al. . | |
| 4,771,729 | 9/1988 | Planert et al. . | |
| 4,792,092 | 12/1988 | Elberson et al. . | |
| 4,879,137 | 11/1989 | Behr et al. . | |
| 4,921,169 | 5/1990 | Tilly . | |
| 4,932,589 | 6/1990 | Diana . | |
| 5,078,168 | 1/1992 | Konieczynski . | |
| 5,083,711 | 1/1992 | Giroux et al. | 239/690 |
| 5,094,389 | 3/1992 | Giroux et al. . | |
| 5,197,676 | 3/1993 | Konieczynski et al. . | |
| 5,221,194 | 6/1993 | Konieczynski et al. | 239/708 X |

FOREIGN PATENT DOCUMENTS

| | | |
|---|---|---|
| 3725172 | 2/1989 | Germany . |
| 8705832 | 10/1987 | WIPO . |

*Primary Examiner*—William Grant
*Attorney, Agent, or Firm*—Holland & Knight

[57] ABSTRACT

An apparatus for transferring electrically conductive coating material comprises a filling station having a first coupling element connected to a source of the coating material and a shuttle carrying a second coupling element which is movable with respect to the filling station between a paint transfer position in which the coupling elements engage and a neutral position physically spaced from the filling station. The shuttle, in turn, is connected to the reservoir of a piston pump which communicates with one or more air operated or air assist spray guns. A high-voltage power supply is connected to the metal body of the piston pump to charge the electrically conductive coating material immediately before it is supplied to the spray gun. A pneumatic/mechanical control system controls the operation of the shuttle, pump and electrostatic power supply to ensure that a voltage block is maintained between the source of coating material and the electrostatically charged coating material which is discharged from the spray gun.

9 Claims, 2 Drawing Sheets

APPARATUS AND METHOD FOR DISPENSING ELECTRICALLY CONDUCTIVE COATING MATERIAL INCLUDING A PNEUMATIC/MECHANICAL CONTROL

This is a continuation of application Ser. No. 08/076,302, filed Jun. 11, 1993, now U.S. Pat. No. 5,341,990.

FIELD OF THE INVENTION

This invention relates to electrostatic spray coating, and, more particularly, to a method and apparatus for dispensing electrically conductive coating materials from at least one manually operated dispenser wherein the source of supply of the electrically conductive coating material is electrostatically isolated from the high voltage electrostatic power supply whenever a dispenser is operating, and wherein such electrostatic isolation is achieved exclusively with pneumatically and mechanically operated controls.

BACKGROUND OF THE INVENTION

The application of coating materials using electrostatic spraying techniques has been practiced in industry for many years. In these applications, the coating material is discharged in atomized form and an electrostatic charge is imparted to the atomized particles which are then directed toward a substrate maintained at a different potential to establish an electrostatic attraction for the charged, atomized particles. In the past, coating materials of the solvent-based variety, such as varnishes, lacquers, enamels and the like, were the primary materials employed in electrostatic coating applications. The problem with such coating materials is that they create an atmosphere which is both explosive and toxic. The explosive nature of the environment presents a safety hazard should a spark inadvertently be generated, such as by accidentally grounding the nozzle of the spray gun, which can ignite the solvent in the atmosphere causing an explosion. The toxic nature of the workplace atmosphere created by solvent coating materials can be a health hazard should an employee inhale solvent vapors.

As a result of the problems with solvent-based coatings, the recent trend has been to switch to water-based coatings which reduce the problems of explosiveness and toxicity. Unfortunately, this switch to water-based type coatings has sharply increased the risk of electrical shock, which risk was relatively minor with solvent-based coatings. The problem of electrical shock has been addressed in U.S. Pat. Nos. 5,078,168 and 5,197,676, both owned by the assignee of this invention. In systems of the type disclosed in these patents, a "voltage block" i.e. an air gap, is provided between one or more sources of the conductive coating material and the electrostatically charged coating material which is directed to the coating dispensers. This voltage block insures that there is never an electrical path between the source of water-based coating material and the high voltage electrostatic power supply.

In systems of the type disclosed in U.S. Pat. Nos. 5,078,168 and 5,197,676, a voltage block is formed by operation of a first shuttle device connected to the reservoir of a first piston pump, and a second shuttle device connected to the reservoir of a second piston pump. The first shuttle is movable with respect to a filling station, which is connected to one or more sources of water-based paint, between a transfer position coupled to the filling station and a neutral position physically spaced or separated by an air gap from the filling station. The second shuttle is movable with respect to a discharge station, which is connected to the reservoir of the first piston pump, between a transfer position coupled to the discharge station and a neutral position spaced from the discharge station. The reservoir of the second piston pump, connected to the second shuttle as noted above, communicates through a feed line with a number of spray guns. Movement of the first and second shuttle devices between their respective transfer and neutral positions is controlled such that when one of the shuttles is in a transfer position the other is in a neutral position to ensure that a voltage block or air gap is constantly maintained at some point along the path from the source(s) of coating material to the coating dispensers. In alternative embodiments of systems of the type disclosed in U.S. Pat. Nos. 5,078,168 and 5,197,676, the second shuttle device and second piston pump can be eliminated in which case the first piston pump is connected directly to one or more manually operated spray guns, and operation of a single shuttle device is controlled to maintain a voltage block between the paint source and spray guns(s).

One potential limitation of voltage block systems of the type disclosed in U.S. Pat. Nos. 5,078,168 and 5,197,676 is that the control system for moving the first shuttle and/or second shuttle between the transfer position and the neutral position includes electrically operated valves, switches and other electrical components. While the shuttles and pumps are driven by pneumatic actuators, the operation of such actuators is nevertheless controlled by electrical valves, switches and the like. Because of the highly conductive nature of water-based coating materials, it is preferable to eliminate, or at least reduce, the amount of system control accomplished by electrical components. Additionally, the control of pneumatic actuators by electrical components complicates the control system, requires special wiring upon installation of the equipment at the customer's facility, and, adds expense both for initial installation and subsequent maintenance.

SUMMARY OF THE INVENTION

It is therefore among the objectives of this invention to provide a method and apparatus for dispensing electrically conductive coating materials, such as water-based paint, which protects against the transmission of an electrostatic charge between the high voltage electrostatic power supply and one or more supplies of conductive coating material, which eliminates electrically actuated controls, and, which is inexpensive to install and maintain.

These objectives are accomplished in an apparatus for transferring electrically conductive coating material, such as water-based paint, from at least one source to one or more coating dispensers or spray guns of the air-assist or atomizing air type. A filling station is connected to the source of water-based paint, and a shuttle is movable with respect to the filling station between a paint transfer position and a neutral position physically spaced from the filling station. The shuttle, in turn, is connected to the reservoir of a piston pump which communicates with one or more air operated or air assist spray guns. A dedicated, high-voltage power supply is connected to the metal body of the piston pump to charge the water-based paint immediately before it is supplied to the spray gun. A pneumatic/mechanical control system controls the operation of the shuttle, pump and electrostatic power supply to ensure that a "voltage block", i.e. an air gap, is maintained between the source of coating material and the electrostatically charged coating material which is supplied to the spray gun.

An important aspect of this invention is the provision of a control system which is simple in operation and eliminates the need for electrical signals to control or initiate any of the system operations. The control system is pneumatic and mechanical in operation and comprises a control valve including a valve body formed with a first passageway having an inlet connected to a source of pressurized air and an outlet connected to a spray gun. The valve body is also formed with a second passageway having an inlet connected to the first passageway, an outlet connected to a pilot operated valve, and, a transfer valve located within the second passageway between its inlet and outlet. The pilot operated valve is effective to selectively direct air to either side of a pneumatic cylinder which moves the shuttle between the transfer position and neutral position, and it also directs air to the piston pump of the system.

In response to actuation of a spray gun, e.g. by depressing the trigger, operating or atomizing air entering the inlet of the control valve unseats a ball carried within the first passageway and flows directly to the spray gun. As the ball moves off of its seat, a lever is pivoted into engagement with a second ball associated with the transfer valve carried in the second passageway of the control valve. Movement of this second ball opens the transfer valve which permits a flow of control air from the first passageway, through the second passageway and then to the pilot of the pilot operated valve. When piloted, the pilot valve causes the pneumatic cylinder associated with the shuttle to move the shuttle to a neutral position, spaced from the filling station. Simultaneously, the pilot valve transmits air to the pump to cause its piston to move in a direction wherein coating material is discharged therefrom to the spraygun(s). Accordingly, in response to activation of the spray gun, the shuttle is moved to the neutral position while coating material is supplied to the spray gun(s) thus providing a voltage block between the source and the spray gun(s).

In the presently preferred embodiment, the control valve is provided with at least two additional ports. One port receives a pressure switch, and another port mounts a needle valve. These ports communicate with the second passageway formed in the valve body of the control valve through which the control air is transferred when the spray gun is actuated, as discussed above. The pressure switch is connected to the electrostatic power supply and functions to activate the power supply whenever control air is permitted to flow to the pressure switch. As a result, the high voltage power supply does not operate to charge coating material within the pump until the flow of control air is initiated, which, as noted above, causes the shuttle to move to the neutral position and electrically isolate the source of coating material from the pump and spray gun.

The purpose of the needle valve mounted to the control valve is to exhaust control air from the flow path between the second passageway of the control valve and the pilot of the pilot valve over a variable period of time. By controlling the time period during which pilot air downstream from the second passageway is permitted to exhaust, the pilot valve can be maintained in the piloted position for a predetermined period, which, in turn, maintains the shuttle in the neutral position and the pump operating to discharge coating material. This enables the painting operator to release the trigger of the spray gun for a few seconds without causing the pilot operated valve to reset and move the shuttle to the transfer position, and/or disconnecting the high voltage power supply.

An important advantage of this invention is therefore the provision of a control system which operates the shuttle, pump and high voltage power supply with pneumatic and mechanical elements. No electrical signals are required to operate valves or other electrical components. This greatly simplifies installation of the system since the apparatus can be connected to readily available shop air within the customer's facility, and no special wiring is required.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
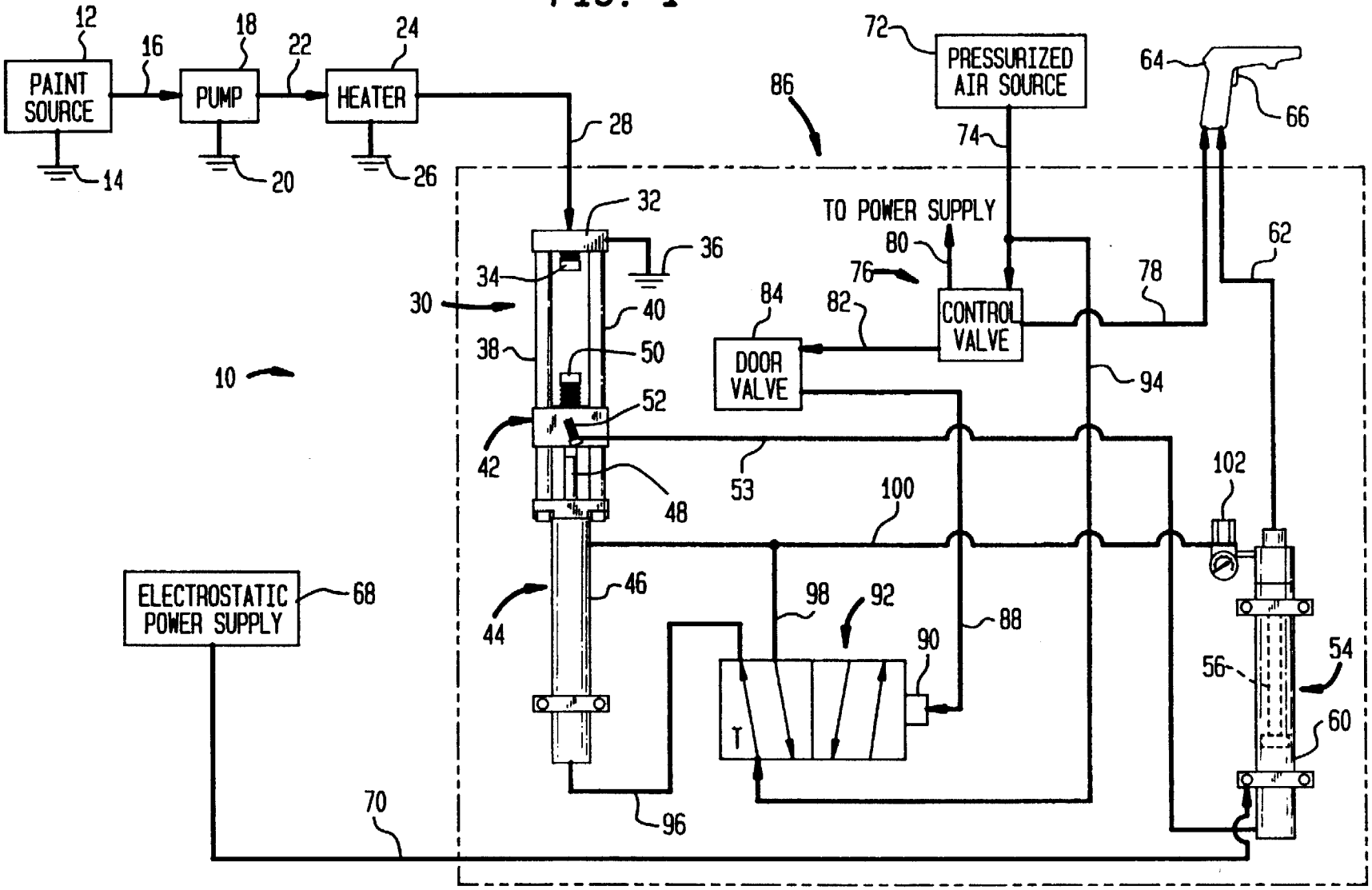
FIG. 1 is a diagrammatic view of the overall construction of the preferred embodiment of this invention.

With reference to FIG. 1, the apparatus 10 of this invention comprises a source of highly conductive coating material, depicted as a paint source 12, which is grounded at 14 and connected by a line 16 to a pump 18 grounded at 20. The pump 18, in turn, is connected by a line 22 to a paint heater 24 which is grounded at 26. The paint heater 24 is optionally included in apparatus 10 for situations wherein the application characteristics of a coating material such as paint are optimized by dispensing the material at elevated temperatures. The paint heater 24 is incorporated within the apparatus 10 at a location which avoids loss of charge at the coating dispensers or spray guns, described below.

The paint is discharged from heater 24 through a line 28 into a voltage block mechanism 30 of the type fully disclosed in U.S. Pat. No. 5,197,696 to Konieczynski, et al., owned by the assignee of this invention, the disclosure of which is incorporated by reference in its entirety herein. For purposes of the present discussion, the voltage block 30 comprises a filling station 32 having a male coupling element 34 connected to line 28. The filling station 32 is grounded at 36. The filling station 32 mounts a pair of spaced rods 38 and 40 along which a shuttle 42 is axially slidable by operation of a pneumatic cylinder 44. The pneumatic cylinder 44 has a cylinder housing 46 mounted to one end of each of the rods 38, 40, and a cylinder rod 48 connected to the shuttle 42. In response to operation of pneumatic cylinder 44, the shuttle 42 is moved along the rods 38, 40 between a coupling or paint transfer position wherein a female coupling element 50 carried by the shuttle 42 engages the male coupling element 34, and a neutral, physically spaced position wherein the shuttle 42 is spaced from the filling station 32. Preferably, the male and female coupling elements 34, 50 are of the type disclosed in U.S. Pat. No. 5,078,168 to Konieczynski, et al., the disclosure of which is incorporated by reference in its entirety herein.

The shuttle 42 has a fitting 52 which is connected by a paint transfer line 53 to the base of a piston pump 54. The piston pump 54 is of the general type disclosed in the aforementioned U.S. Pat. No. 5,078,168, the details of which form no part of this invention and are therefore not discussed herein. As schematically depicted in FIG. 1, the piston pump 54 includes a piston 56 which is axially slidable within the housing 60 of the piston pump 54. In response to movement of the piston 56 in a downward direction, as depicted in FIG. 1, coating material within the piston pump 54 is transferred through line 62 to spray gun 64 having an actuator or trigger 66. The spray gun 64 is preferably an air type gun where atomization of the paint takes place by impacting a stream of paint with one or more jets of air. These types of spray guns are available commercially and one suitable gun is disclosed, for example, in U.S. Pat. No. 4,294,411 to Hastings, et al., owned by the assignee of this invention. Alternatively, an air assist type spray gun can be utilized with the apparatus 10 of this invention wherein atomization of the paint takes place hydraulically, and a stream or fan of air is supplied to the gun to shape the pattern of atomized paint discharged from the gun. One type of air assist spray gun suitable for use in the apparatus 10 is disclosed in U.S. Pat. No. 3,843,052 to Cowan.

In the presently preferred embodiment, a high voltage electrostatic power supply 68, schematically depicted in FIG. 1, is connected by a high voltage line 70 to the housing 60 of piston pump 54. The details of the structure for interconnecting the power supply 68 with piston pump 54 form no part of this invention, and reference can be made to U.S. Pat. No. 5,197,676, mentioned above, for a detailed discussion of same.

Pneumatic/Mechanical Control

An important aspect of this invention is the provision of a pneumatic/mechanical control system for the operation of pneumatic cylinder 44, piston pump 54 and power supply 68. With reference initially to FIG. 1, this control system includes a pressurized air source 72 which is depicted schematically by a block in FIG. 1 and is meant to designate a source of pressurized shop air available in most manufacturing facilities. Air source 72 is connected by an air supply line 74 to a control valve 76 described in detail below. The control valve 76 is connected by a line 78 to the spray gun 64, by a line 80 to the electrostatic power supply 68, and, by a line 82 to a door valve 84. The door valve 84 is schematically depicted by a block in FIG. 1 and is meant to refer to a valve associated with a door (not shown) of a cabinet 86. The cabinet 86 is illustrated in phantom in FIG. 1 and encloses the voltage block 30, control valve 76 and pump 54. As discussed in more detail below in connection with a description of the operation of apparatus 10, the door valve 84 is effective to ground the system in the event the cabinet door is opened at any time.

A line 88 interconnects the door valve 84 with the pilot 90 of a pilot operated valve 92 depicted schematically in FIG. 1. Pressurized air is supplied to the pilot valve 92 through a line 94 connected to the air supply line 74 from air source 72 at a location upstream from control valve 76. In turn, the pilot valve 92 is connected by an air line 96 to the base of pneumatic cylinder 44 associated with shuttle 42. Additionally, a branch line 98 from pilot valve 92 is connected to a common line 100 extending between the top of pneumatic cylinder 44 and a pressure regulator 102 mounted to the piston pump 54.

Figure 3:
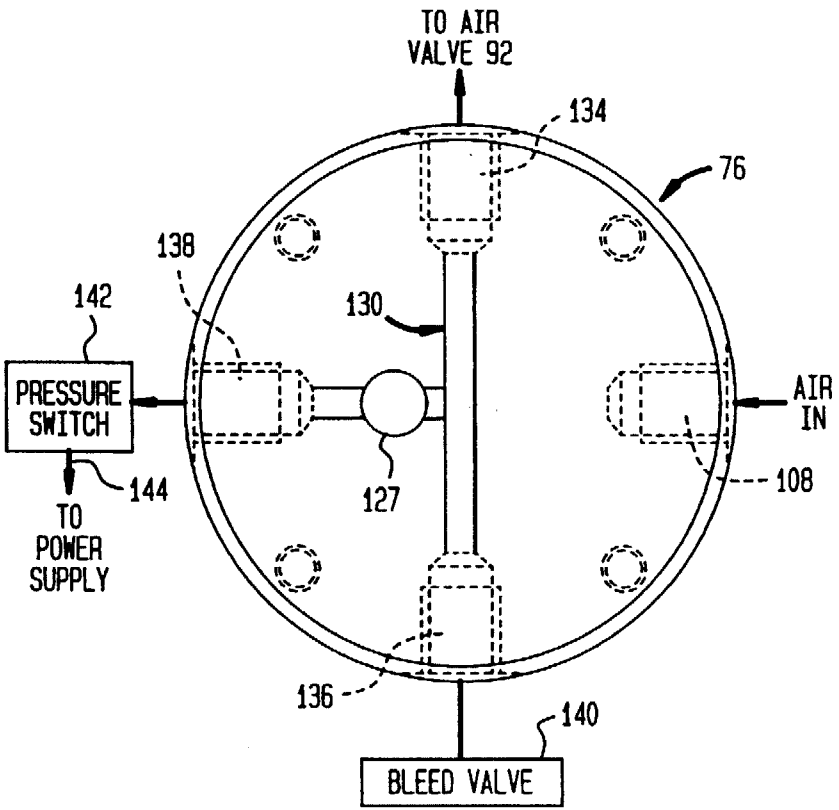
FIG. 3 is a cross-sectional view of the air valve illustrating the ports formed therein.
Figure 2:
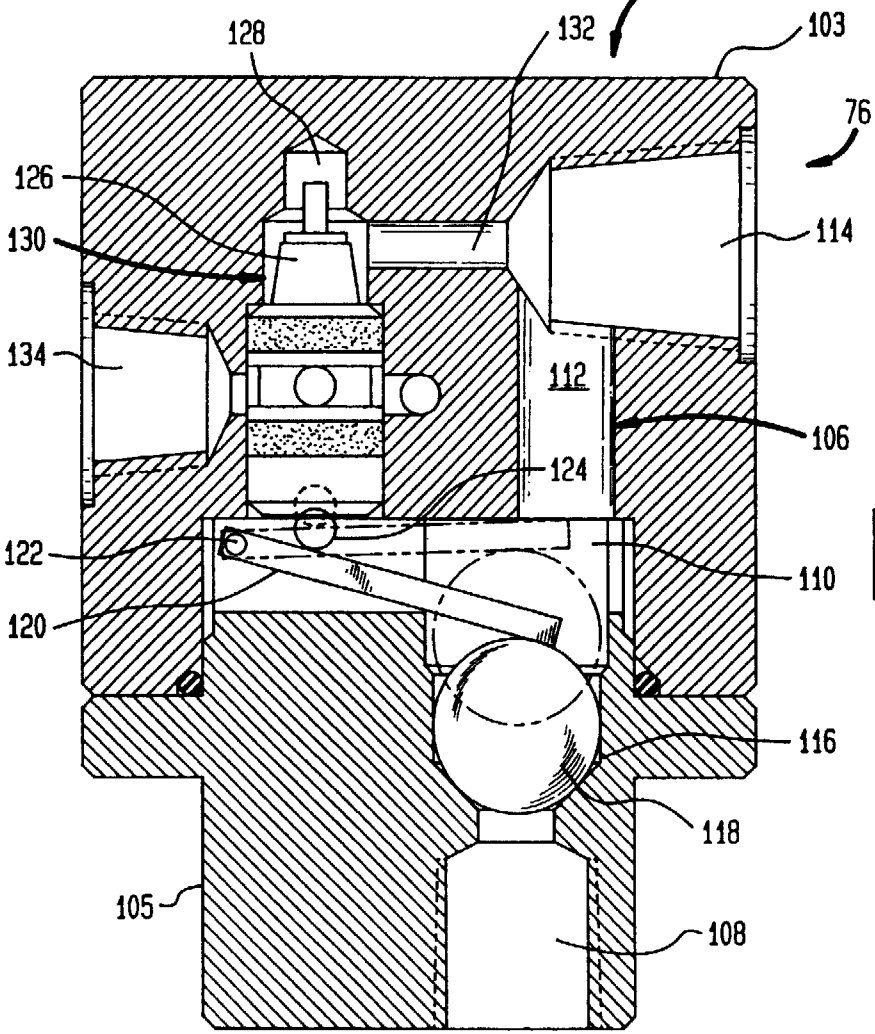
FIG. 2 is cross-sectional view of the air valve herein.

With reference to FIGS. 2 and 3, the construction of control valve 76 is illustrated in more detail. Control valve 76 comprises a two-piece valve body 104 having an upper section 103 and a lower section 105 which are interconnected and sealed by an o-ring 107. The valve body 104 is formed with a first passageway 106 which includes an inlet 108, a cavity 110, a connector bore 112 and an outlet 114. The inlet 108 of first passageway 106 is connected to the air supply line 74, and its outlet 114 is connected via line 78 to the spray gun 64. The valve body 104 is formed with a seat 116 in the transition area between the inlet 108 and cavity 110 of first passageway 106, and this seat 116 receives a first ball 118 preferably made of metal or other suitable material. The first ball 118 is engagable with a lever 120, carried within the cavity 110, which is pivotally mounted at one end to the valve body 104 by a pin 122. The lever 120 is pivotal between a neutral position depicted in solid lines in FIG. 2, and an activating position depicted in phantom in such Fig., dependent upon the position of first ball 118 as discussed in detail below. In the course of movement to the activating position, the lever 120 engages a second ball 124 associated with a transfer valve 126 preferably of the type sold by Nordson Corporation of Westlake, Ohio under Nordson Part No. 324261. The transfer valve 126 has an outlet 127 and is carried within a chamber 128 which forms part of a second passageway 130 within the valve body 104. This second passageway 130 also includes an inlet 132 interconnecting the first passageway 106 and chamber 128, and an outlet 134 interconnecting the chamber 128 with the line 88 leading to the pilot 90 of pilot valve 92. As discussed in more detail below, when the transfer valve 126 is opened by movement of the second ball 124 in response to pivoting of lever 120, control air is allowed to flow from the first passageway 106, through transfer valve 126 and out of the outlet 134 of second passageway 130 into the line 88 leading to pilot valve 92.

The valve body 104 of control valve 76 is preferably formed with at least two additional ports 136 and 138 which communicate with the second passageway 130 mentioned above. The port 136 mounts a bleed valve 140, which is preferably a needle valve sold commercially by the Clippard Laboratories, Inc. of Cincinnati, Ohio under Clippard Model No. MNV-1P. The second port 138 mounts a pressure switch 142 which is connected by a line 144 to the high voltage electrostatic power supply 68. The functions of bleed valve 140 and pressure switch 142 are discussed below in connection with a description of the operation of apparatus 10.

System Operation

With reference to FIG. 1, the apparatus 10 of this invention operates as follows. In order to fill the piston pump 54 with paint in preparation for transmission to spray gun 64, pressurized air from source 72 is supplied through air supply line 74 and line 94 to the pilot valve 92. In the unpiloted position, pilot valve 92 allows a flow of air from line 94 to pass therethrough and enter line 96 which is connected to the bottom of pneumatic cylinder 44. In response to pressurization of the base of pneumatic cylinder 44, its piston 48 is extended to move shuttle 42 into position wherein the female coupling element 50 carried by shuttle 42 engages the male coupling element 34 at the filling station 32. With the male and female coupling elements 34, 50 engaged, paint is supplied from paint source 12 through lines 16, 22 and 28 to the filling station 32 where it enters the shuttle 42 through coupling elements 34, 50. The paint is transmitted from shuttle 42 through paint transfer line 53 to the base of piston pump 54 which fills its housing 60 causing the piston 56 to move axially upwardly therein. The piston pump 54 is quickly filled with paint, and the filling station 32 and shuttle 42 remain in engagement with one another until activation of spray gun 64 as described below.

Electrostatic charging of the coating material within piston pump 54, and its transmission to the spray gun 64, is initiated by actuating the spray gun 64, i.e. depressing its trigger 66. When the gun trigger 66 is depressed, pressurized air is exhausted from line 78 interconnecting the control valve 76 with spray gun 64. This creates a pressure drop within first passageway 106 of control valve 76, upstream from the first ball 118 and lever 120, thus allowing pressurized air from line 74 connected to the inlet 108 of first passageway 106 to move the first ball 118 away from its seat 116 within the valve body 104 to a position shown in phantom in FIG. 2. The pressurized air flows past the first ball 118, through first passageway 106 into line 78, and then to the spray gun 64. As mentioned above, the pressurized air discharged through line 78 functions to either atomize the coating material discharged from a spray gun of the type disclosed in U.S. Pat. No. 4,294,411, or, alternatively, the pressurized air is utilized to shape the pattern of coating material discharged from air assist spray guns of the type disclosed in U.S. Pat. No. 3,843,052.

In the course of movement of the first ball 118 from its seat 116, the lever 120 is pivoted on pin 122 from the position shown in solid lines in FIG. 2 to the position shown in phantom lines. As noted above, such pivotal motion causes the second ball 124 associated with transfer valve 126 to move into a position shown in phantom in FIG. 2 which opens the transfer valve 126. As a result, pressurized air flowing through the first passageway 106 is allowed to flow into the inlet 132 of second passageway 130, through the now open transfer valve 126, and then into the outlet 134 of second passageway 130. Assuming the door of cabinet 86 is closed, the flow of air from second passageway 130 of control valve 76 enters line 82, passes directly through door valve 84, and flows into the line 88 connected to the pilot 90 of pilot valve 92.

When piloted by the air supplied from control valve 76, the pilot valve 92 shifts position from that described above wherein pump 54 is filled with paint. In the shifted position, the flow of air through pilot valve 92 into line 96 and then to the base of pneumatic cylinder 44 is terminated, while a flow of control air from pilot valve 92 into branch line 98 is initiated. The control air from pilot valve 92 enters common line 100 to perform two functions. First, as noted above, one end of common line 100 transmits air to the top of pneumatic cylinder 44 causing the piston 48 to move in a downward direction, as depicted in FIG. 1, thus moving shuttle 42 to a neutral position spaced from filling station 32. With the shuttle 42 in the neutral position, an effective voltage block or air gap is created between the paint source 12 and the piston pump 54 filled with paint to be dispensed to spray gun 64. Secondly, the control air from pilot valve 92 flows to the other end of common line 100 where it is connected to the pressure regulator 102 associated with piston pump 54. The pressure regulator 102 controls the pressure of the air flowing into the piston pump 54, which, in turn, causes its piston 56 to move axially downwardly as depicted in FIG. 1 to force paint contained within the pump housing 60 to flow through line 62 to the spray gun 64 where it is discharged onto a substrate. Accordingly, the pneumatic/mechanical operation of control valve 76, actuated in response to activation of the gun trigger 66, causes the shuttle 42 to move to the neutral position and operates the piston pump 54 to discharge coating material therefrom to the spray gun 64.

Two other features of the control valve 76 add further controls to the operation of apparatus 10. As depicted in FIG. 3, the port 138 of control valve 76, which is connected to the second passageway 130, mounts a pressure switch 142. In response to the flow of control air through the second passageway 130, in the manner described above, a flow of air is directed through port 138 to activate the pressure switch 142. Once activated, the pressure switch 142 is effective to send a signal to the electrostatic power supply 68, as depicted schematically in FIG. 1, which operates the power supply 68 to supply power via line 70 to the housing 60 of piston pump 54. This causes the coating material or paint within the piston pump 54 to become electrostatically charged prior to transmission to the spray gun 64. Importantly, the power supply 68 is not activated until such time as control air is allowed to flow within second passageway 130 of control valve 76. As discussed above, this same control air from second passageway 130 is supplied to the pilot valve 92, which, in turn, operates the pneumatic cylinder 44 to move the shuttle 42 to a neutral position. Therefore, activation of the power supply 68 and movement of the shuttle 42 to the neutral position occur at approximately the same time to maintain a voltage block between the paint source 12 and the charged coating material. In the event power supply 68 is activated slightly in advance of movement of shuttle 42 to the neutral position, which is possible due to the time required to activate the pilot valve 92 and pneumatic cylinder 44, the coating material within paint source 12 is nevertheless protected against becoming electrostatically charged because the filling station 32 of voltage block 30 is grounded at 36.

Another feature of control valve 76 is the presence of bleed valve 140 mounted to the port 136 within valve body 104 which communicates with the second passageway 130 therein. The purpose of the bleed valve 140 is to variably control the time period during which pressurized control air is permitted to bleed off from the flow path interconnecting the control valve 76 and the pilot 90 of pilot valve 92. In many manual paint spraying operations, the operator paints in a side-to-side motion wherein he or she depresses the trigger during one "pass" or spraying motion, and then releases the trigger to return to the initial starting point in preparation for another pass. In order to permit the operator to release the gun trigger 66 for a short period of time, e.g. on the order of a few seconds, the bleed valve 140 is adjusted to maintain air pressure on the pilot 90 of pilot valve 92 for a predetermined time period, i.e. the air within lines 82 and 88 is bled off from pilot 90 through bleed valve 140 within a preset period of time. For example, the bleed valve 140 could be set to permit a five second delay during which time the pressure within lines 82 and 88 is maintained at a sufficient level to operate the pilot 90 of pilot valve 92. As noted above, when the pilot valve 92 is piloted, the shuttle 42 is in the neutral position and the coating material is electrostatically charged as it is transmitted from pump 54 to spray gun 64. After this delay period of five seconds has expired, the control air within lines 82 and 88 is sufficiently exhausted through bleed valve 140 to cause the pilot valve 92 to shift back to its initial position. As described above, in the initial or "fill" position, the pilot valve 92 allows air to flow through line 96 to the base of pneumatic cylinder 44 thus moving its shuttle 42 to the transfer position wherein coating material is supplied via line 53 from the filling station 32 and shuttle 42 to the piston pump 54. Additionally, when the pressure within second passageway 130 drops to a level sufficient to shift pilot valve 92, the pressure switch 142 is also operated to shut down the electrostatic power supply 68.

While the invention has been described with reference to a preferred embodiment, it should understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the apparatus 10 as depicted in the Figs. employs a high voltage power supply 68 located exteriorly of the cabinet 86 and separate from the spray gun 64. Operation of the power supply 68 is controlled by control valve 76 and pressure switch 142 as described above. It is contemplated, however, that the apparatus 10 of this invention can be utilized with electrostatic spray devices in which an electrostatic charge is imparted to the coating material within the spray gun or as the coating material is emitted from the spray gun. In systems of this type, the electrostatics are connected directly to the spray gun and activated in response to triggering of the gun. Using the apparatus of this invention with spray guns of this type, the pressure switch 142 is eliminated and activation of the electrostatics is controlled by operation of the gun itself.

Therefore, it is intended that the invention not be limited to the particular embodiment disclosed as the best mode contemplated for carrying out this invention, but that the invention will include all embodiments falling within the scope of the appended claims.

I claim:

1. Apparatus for supplying and dispensing electrically conductive coating material, comprising:

a coating dispenser having an actuator which is movable to an operating position to initiate discharge of coating material therefrom, said coating dispenser employing pressurized air in the operation thereof;

a container which is effective to receive coating material and then transmit the coating material to said coating dispenser;

a voltage block including a first coupling element movable in response to operation of a pneumatic actuator to a first position at which coating material is transmitted from a source of coating material to said container, and to a second position at which said container is electrically isolated from the source of coating material;

a high voltage electrostatic power supply operative to apply an electrostatic charge to the coating material which is discharged from said coating dispenser;

a control valve, connected to a source of pressurized air, which is operative in response to movement of said coating dispenser actuator to said operating position, to:

(i) transmit pressurized air to said coating dispenser; and (ii) transmit pressurized air to said pneumatic actuator of said voltage block to cause said first coupling element thereof to move to said second position.

2. The apparatus of claim 1 in which said voltage block includes a shuttle carrying said first coupling element, and a filling station carrying a second coupling element which mates with said first coupling element, said second coupling element being adapted to connect to the source of coating material, said pneumatic actuator of said voltage block comprising a pneumatic cylinder which is operative to move said shuttle between said first position wherein said first and second coupling elements mate with one another and said second position wherein said first coupling element is spaced from said second coupling element.

3. The apparatus of claim 2 in which said voltage block includes a pilot operated valve connected to said control valve and adapted to be connected to the source of pressurized air, said pilot operated valve being effective in response to receipt of pressurized air from said control valve to operate said pneumatic cylinder so that said shuttle is moved to said second position, said pilot operated valve being effective to operate said pneumatic cylinder to move said shuttle to said first position when the supply of pressurized air from said control valve is terminated.

4. The apparatus of claim 3 further including a bleed valve connected to said control valve and communicating with said pilot operated valve of said voltage block, said bleed valve being effective to adjustably reduce the pressure of the air between said control valve and said pilot operated valve over a selected period of time to cause said pilot operated valve to maintain said first coupling element of said voltage block in said second position during said selected time period.

5. Apparatus for supplying electrically conductive coating material to a coating dispenser having an actuator movable to an operating position to initiate discharge of the coating material therefrom and employing pressurized air in the operation thereof, said apparatus comprising:

a container which is effective to receive coating material and then transmit the coating material to the coating dispenser;

a voltage block including a first coupling element movable in response to operation of a pneumatic actuator to a first position at which coating material is transmitted from a source of coating material to said container, and to a second position at which said container is electrically isolated from the source of coating material;

a high voltage electrostatic power supply operative to apply an electrostatic charge to the coating material;

a control valve, connected to a source of pressurized air, which is adapted to operate in response to movement of the coating dispenser actuator to the operating position, to:

(i) transmit pressurized air to the coating dispenser; and (ii) transmit pressurized air to said pneumatic actuator of said voltage block to cause said first coupling element thereof to move to said second position.

6. The apparatus of claims 5 in which said voltage block includes a shuttle carrying said first coupling element, and a filling station carrying a second coupling element which mates with said first coupling element, said second coupling element being adapted to connect to the source of coating material, said pneumatic actuator of said voltage block comprising a pneumatic cylinder which is operative to move said shuttle between said first position wherein said first and second coupling elements mate with one another and said second position wherein said first coupling element is spaced from said second coupling element.

7. The apparatus of claim 6 in which said voltage block includes a pilot operated valve connected to said control valve and adapted to be connected to the source of pressurized air, said pilot operated valve being effective in response to receipt of pressurized air from said control valve to operate said pneumatic cylinder so that said shuttle is moved to said second position, said pilot operated valve being effective to operate said pneumatic cylinder to move said shuttle to said first position when the supply of pressurized air from said control valve is terminated.

8. In an apparatus for supplying electrically conductive coating material from a source, through a voltage block to a coating dispenser, a control valve comprising:

a valve body formed with a first passageway having an inlet adapted to connect to a source of pressurized air, an outlet adapted to connect to the coating dispenser, and a seat located between said inlet and said outlet;

said valve body being formed with a second passageway having an inlet connected to said first passageway and an outlet adapted to be connected to the voltage block;

a closure element, located in said first passageway, which is movable to an open position with respect to said seat in response to actuation of the coating dispenser to permit the flow of pressurized air from the source of pressurized air, through said first passageway and to the coating dispenser;

a transfer valve, located within said second passageway, which is responsive to movement of said closure element to said open position to permit a flow of pressurized air from said first passageway, through said second passageway to the voltage block so that the source of coating material is electrically isolated from the coating dispenser.

9. The control valve of claim 8 in which said closure element is a ball movable between an open and closed position relative to said seat.

* * * * *